United States Patent [19]

Da Costa

[11] Patent Number: 4,973,230

[45] Date of Patent: Nov. 27, 1990

[54] DISCHARGE SYSTEM FOR HERMETIC COMPRESSOR

[75] Inventor: Caio M. F. N. Da Costa, Joinville, Brazil

[73] Assignee: Empresa Brasileira De Compressores S/A Embraco, Joinville, Brazil

[21] Appl. No.: 362,764

[22] Filed: Jun. 7, 1989

[30] Foreign Application Priority Data

Sep. 6, 1988 [BR] Brazil ..... 8802893

[51] Int. Cl.[5] ..... F04B 17/00; F01C 13/00

[52] U.S. Cl. ..... 417/312; 417/902; 418/181

[58] Field of Search ..... 418/60, 63, 181; 417/312, 542, 902; 137/542

[56] References Cited

U.S. PATENT DOCUMENTS 3,056,542 10/1962 Galin ..... 418/63

4,336,824 6/1982 Steineman ..... 137/542

4,730,996 3/1988 Akatsuchi et al. ..... 418/181

*Primary Examiner*—Donald E. Stout

*Assistant Examiner*—John A. Savio, III

*Attorney, Agent, or Firm*—Darby & Darby

[57] ABSTRACT

A discharge system for a hermetic compressor of the type that comprises a shell in whose interior a cylinder is housed defining a compression chamber in conjunction with a rolling eccentric piston driven by an electric motor, such cylinder having a discharge orifice in communication with a discharge valve to communicate the compression chamber with a discharge muffler chamber. The discharge orifice has a surrounding wall defining a valve seat on the internal face of the discharge muffler chamber. The discharge valve in the muffler chamber comprises a disc; disc guide means fastened in an inner wall of the discharge muffler chamber; and an elastic biasing element forcing the sealing disc against the valve seat and dimensioned to allow the sealing disc to be displaced off the when a certain pressure in the compression chamber is reached.

5 Claims, 1 Drawing Sheet

DISCHARGE SYSTEM FOR HERMETIC COMPRESSOR

BACKGROUND OF THE INVENTION

The present invention relates to a hermetic compressor for small refrigeration appliances, and more specifically to a new constructive solution for the discharge system of a hermetic compressor such as rotary rolling piston type compressor.

The construction of the discharge system in hermetic compressors, especially on rotary rolling piston ones, has an immediate influence on energy and volumetric losses of the compressor.

One of these is the energy loss by over-pressure which has to do with the opening readiness of the discharge valve after the pressure in the cylinder compression chamber has reached the discharge pressure and also, the inadequate efficiency of the discharge system to evacuate the gas to be discharged, as promptly as possible, once the valve is open. In situations which the discharge valve will not open appropriately, the over pressure condition inside of the cylinder compression chamber will occur and, the greater the part of the compression cycle, the greater will be the effort and the energy loss which the compressor crankshaft will have to overcome.

Another type of loss is due to the energy and volumetric losses in terms of existence of the dead volume in the discharge orifice of the compression chamber. What occurs is that the dead volume of the gas left in the discharge orifice returns after each compression cycle to the cylinder, taking up the space of the gas to be accepted at every new suction cycle, causing a relevant volumetric loss. Besides that, the gas that occupies the dead volume in the discharge orifice will be compressed at every compression cycle but will not be discharged from the cylinder, causing the discharge energy in this compression to be wasted, becoming an energy loss of the compressor.

In view of the above, it can be stated that the judicious definition of the construction characteristics of the discharge system is an important part of the dimensioning of a hermetic compressor.

The most conventionally adopted solution for the discharge system of hermetic compressors, especially those of rotary rolling piston type, is the provision of a reed valve with its bumper fastened through screws or rivets to the same plate on which the discharge orifice is arranged.

Another solution for discharge system of the prior art compressors is the use of a cylindrical reed valve, in which a spring steel blade of cylindrical shape is disposed in the interior of the cylinder body, transversely to the discharge orifice, as proposed by U.S. Pat. No. 4,537,567.

Both the reed valve and cylindrical reed valve present operational and construction inconveniences which end up causing energy and volumetric losses in the compressor.

These well-known valves present fastening through their shaft which is fastened to the holding screw or rivet. This construction arrangement provides an inevitable restriction to the discharge free flow.

Besides the above inconvenience, the known valves are open in an inclined way (non-parallel) to the seat, which brings an asymmetry to the discharge flow, making it difficult.

The above operational and constructive characteristics commented upon using reed valves and cylindrical reed valves impair the gas discharge flow of the cylinder compression chamber, increasing the energy loss by over-pressure.

Besides the above problem, the reed valve also presents the disadvantage of needing a quite large seat area which requires a greater thickness of the cylinder body plate on which is provided the seat and the discharge orifice, so that this plate has sufficient mechanical resistance to support the gas compression efforts without deflecting.

In this way, the greater thickness of the already mentioned plate or cylinder wall gives rise to an increase of the discharge orifice length machined in said plate, which, in turn, increases the dead volume of gas in the interior of this discharge orifice with all disadvantages mentioned above.

In spite of minimizing the problem of dead volume at the compression chamber outlet, the cylindrical reed valve requires the provision of a plurality of passages often in parallel to each other and disposed on the cylinder wall, transversely to the discharge orifice and, radially regarding the valve cylindrical blade, so as to interconnect the mentioned discharge orifice with the valve body interior. This type of building structure is difficult to make. Another serious deficiency of both solutions relates to the difficulty of manufacturing the seats. Reed valve seats require a large surface and a complex geometry. On the other hand, the cylindrical reed valve presents a simple geometry but, the building structure is of difficult execution as mentioned above.

OBJECTS OF THE INVENTION

It is an object of the present invention to provide a discharge system for a hermetic compressor, such as used in small refrigeration appliances, which is able to minimize the energy and volumetric losses in the compressor regarding the opening efficiency of the discharge valve and gas evacuation through itself and also, the defined gas volume in the gas discharge orifice.

It is also an object of the present invention to provide a discharge system of the type above mentioned which has a simple assembly with an acceptable cost.

BRIEF DESCRIPTION OF THE INVENTION

Such discharge system is applicable to the hermetic compressor including a shell or housing in whose interior a cylinder is housed defining a compression chamber together with a piston having an eccentric part driven by a shaft carried by an electric motor, such cylinder presenting a discharge orifice operationally associated to a discharge valve in order to communicate the compression, chamber with a discharge muffler chamber.

According to the present invention the discharge system comprises: a discharge orifice intercommunicating with the cylinder compression chamber and a discharge muffler chamber; a valve seat is defined at the end of the discharge orifice on the inner face of the discharge muffler chamber; and, a discharge valve in the discharge muffler chamber having a sealing disc axially movable between a seating position on the valve seat and a position away from the seat; disc guide means fastened to the discharge muffler chamber, and an elastic biasing element disposed in such a way to constantly force the sealing disc to seat itself on the valve seat and also, dimensioned to permit the axial displacement of the sealing disc away from the seat when the gas pressure inside the compression chamber reaches a certain value.

The discharge system above defined has s simple assembly and does not need to be fastened by rivets or screws. The valve with sealing disc allows the discharge flow to take place freely, without shocking against the means for valve fastening. The fact of the sealing disc acts in a parallel way (not-inclined) in relation to the valve seat also facilitates the discharge flow by eliminating asymmetries on itself.

The new system also presents a minimum valve seating area (seat) which allows to minimize the plate thickness where the seat is machined with no problems of deflection and mechanical resistance, so that, it can reduce the dead volume contained in the discharge orifice and all losses caused by it.

This discharge system also has the advantage that the necessary machining of the seat becomes easily facilitated; the only thing needed is the shape of a hole.

BRIEF DESCRIPTION OF THE DRAWINGS

The invention will become more apparent by reference to the description of the accompanying drawings, wherein.

DETAILED DESCRIPTION OF THE INVENTION

Figure 1:
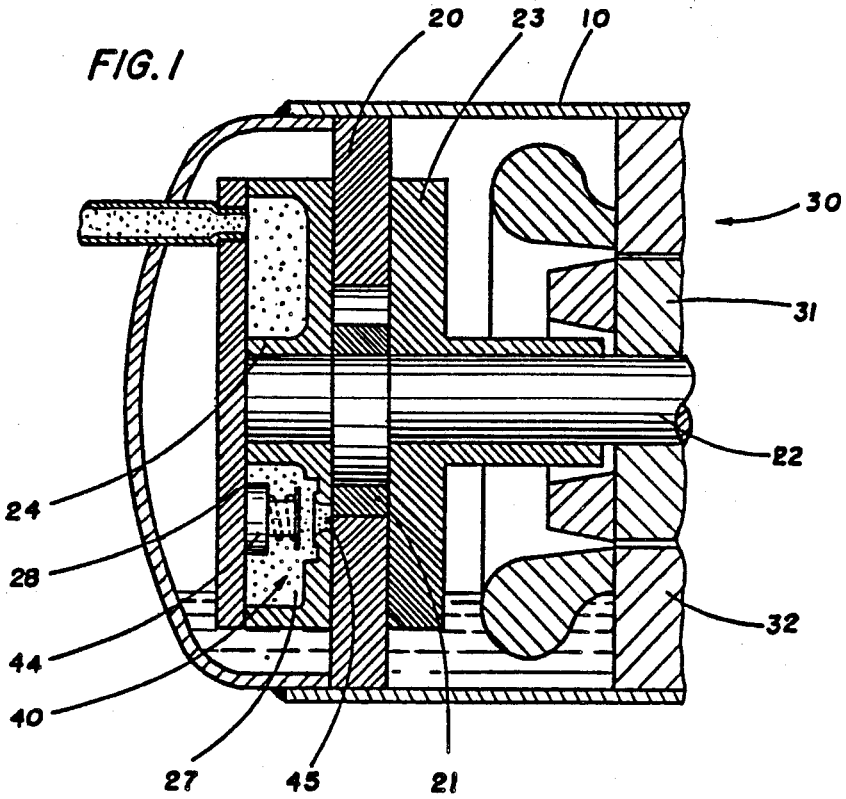
FIG. 1 is a simplified longitudinal sectional view of a rotary rolling piston hermetic compressor including the discharge valve of the present invention.

According to the drawings above mentioned, this discharge system can be used, for example, in horizontal rolling piston hermetic compressor, including a shell or housing 10 in which interior a cylinder 20 is fastened, housing a rolling piston 21 having an eccentric part driven by shaft 22 supported by a main bearing 23 and a sub bearing 24.

The shaft 22 is driven by the rotor 31 of an electric motor 30 whose stator 32 is mounted in the interior of the shell 10.

Together with the cylinder 20 outer wall a discharge muffler chamber 27 is provided being closed by an outer cover plate "26". In the interior of the cylinder 20 and around the rolling piston 21 and between the opposing faces of the two bearings 23, 24 a suction chamber and a compression chamber (not illustrated) of well-known construction and operation are defined as the piston is rotated.

Figure 2:
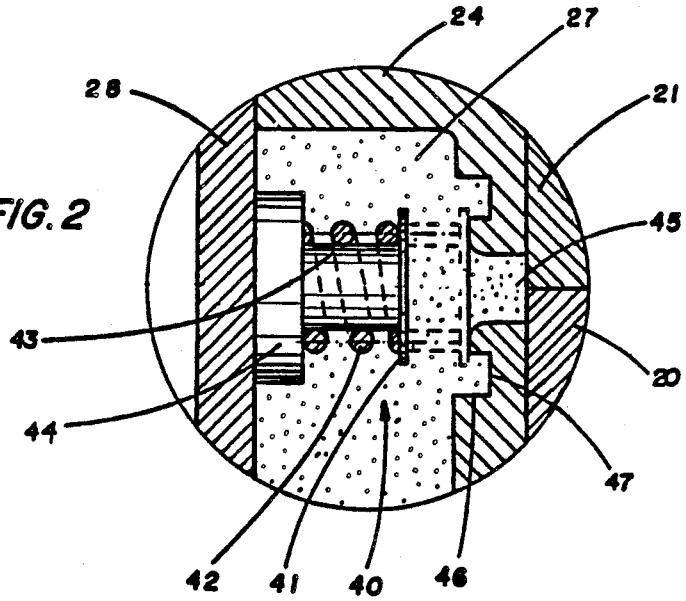
FIG. 2 illustrates an amplified detail of part of FIG. 1, showing the discharge valve construction.

According to the invention, the compression chamber is in communication with the interior of the discharge muffler chamber 27 through an axial discharge orifice 45 whose outlet extreme is surrounded by a circular wall area 40 within a circular recess 46, provided with a bottom ring groove 47, machined on the inner wall of the discharge muffler chamber 27 (See FIG. 2).

The peripheral wall 49 defines the seat for a sealing disc 41 of a discharge valve 40 mounted on the inner side of the muffler chamber 22.

The sealing disc 41 is arranged in a plane parallel to the plane of the seat 49 which is assembled on the extreme of a helical spring 42 arranged around a pin 43, coaxial to the discharge orifice 45 and fastened to the inner wall of muffler chamber cover plate 28 by adequate construction, e.g., with the assistance of an intermediate space support 44, and appropriate welds. The tension of spring 42 is selected to permit the valve seat 41 to open upon a predetermined pressure being present in the compression chamber which is in communication with the discharge orifice 45.

Despite only one embodiment being illustrated here, it must be understood that it will be possible to make different constructive arrangements for the valve 40 without changing its operational principle regarding the seat 46-47. The spring 42 may be replaced by any other suitable elastic biasing means and the pin 43 can be fastened to the sealing disc 41 and guided in an opening made on the support 44.

The construction of the valve 40 allows the sealing disc 41 to be constantly forced to seat on the seat 49 by the spring action 42 which is dimensioned to permit the valve opening (the sealing disc 41 removal regarding the seat 49) at the time that the gas pressure in the inner side of the compression chamber reaches a certain predetermined value.

I claim:

1. A compressor comprising:

a housing, a cylinder mounted within said housing, a piston having an eccentric for rotation within said cylinder and defining with the cylinder a compression chamber and an exhaust chamber, means forming a muffler chamber external to said cylinder, said chamber forming means having an inlet orifice with a valve seat surface therearound in communication with said compression chamber and a cover plate remote from and opposing the valve sear surface for closing said external chamber, valve means in said muffler chamber having a sealing disc to seat on said orifice opening valve seat, guide means on said cover plate extending towards said valve seat surface and means for biasing said sealing disc against said seat, said biasing means selected to be responsive to a predetermined pressure in the compression chamber to unseat said sealing disc, said guide means on said cover plate extending toward said valve seat surface to guide the placement of said disc toward and away from the valve seat.

2. A compressor as in claim 1 wherein said sealing disc is attached to said biasing means.

3. A compressor as in claim 1 wherein said guide means comprises a pin fixed to said muffler chamber end plate remote from said orifice and coaxial therewith.

4. A compressor as in claim 3 wherein said biasing means is a helical spring located around said pin.

5. A compressor as in claim 4 wherein said sealing disc is fixed to an end of said helical spring.

* * * * *

UNITED STATES PATENT AND TRADEMARK OFFICE

CERTIFICATE OF CORRECTION

PATENT NO. : 4,973,230

DATED : November 27, 1990

INVENTOR(S) : CAIO MARIO FRANCO NETTO DA COSTA

It is certified that error appears in the above—identified patent and that said Letters Patent is hereby corrected as shown below:

On the title page, item [30]:

Please change the filing date of the priority document from "9/6/88" to --6/9/88--.

Signed and Sealed this

Nineteenth Day of May, 1992

*Attest:*

DOUGLAS B. COMER

*Attesting Officer*

*Acting Commissioner of Patents and Trademarks*